US010796640B2

(12) United States Patent
Qing

(10) Patent No.: US 10,796,640 B2
(45) **Date of Patent: *Oct. 6, 2020**

(54) PIXEL CIRCUIT, DISPLAY PANEL, DISPLAY APPARATUS AND DRIVING METHOD

(71) Applicants: BOE TECHNOLOGY GROUP CO., LTD., Beijing (CN); CHENGDU BOE OPTOELECTRONICS TECHNOLOGY CO., LTD., Sichuan Province (CN)

(72) Inventor: Haigang Qing, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 401 days.

This patent is subject to a terminal disclaimer.

(21) Appl. No.: 15/753,242

(22) PCT Filed: Jul. 14, 2017

(86) PCT No.: PCT/CN2017/092964

§ 371 (c)(1),
(2) Date: Feb. 16, 2018

(87) PCT Pub. No.: WO2018/054141

PCT Pub. Date: Mar. 29, 2018

(65) Prior Publication Data

US 2020/0219445 A1 Jul. 9, 2020

(30) Foreign Application Priority Data

Sep. 22, 2016 (CN) ..... 2016 1 0842193

(51) Int. Cl.

| | |
|---|---|
| ***G09G 3/3258*** | (2016.01) |
| ***G09G 3/3291*** | (2016.01) |
| ***G09G 3/3266*** | (2016.01) |

(52) U.S. Cl.
CPC ..... *G09G 3/3258* (2013.01); *G09G 3/3266* (2013.01); *G09G 3/3291* (2013.01); *G09G 2300/0852* (2013.01)

(58) Field of Classification Search
CPC .. G09G 3/3258; G09G 3/3266; G09G 3/3291; G09G 2300/0852
See application file for complete search history.

(56) References Cited

U.S. PATENT DOCUMENTS

2011/0273428 A1* 11/2011 Han ..... G09G 3/3283 345/212
2013/0043802 A1* 2/2013 Han ..... G09G 3/3233 315/240

(Continued)

FOREIGN PATENT DOCUMENTS

CN 102956192 A 3/2013
CN 103000133 A 3/2013

(Continued)

OTHER PUBLICATIONS

Search Report for International Application No. PCT/CN2017/092964 dated Oct. 13, 2017.

(Continued)

*Primary Examiner* — Sahlu Okebato
(74) *Attorney, Agent, or Firm* — Calfee, Halter & Griswold LLP

(57) ABSTRACT

A pixel circuit is disclosed that includes a data write circuit, a reset circuit, a first storage circuit, a second storage circuit, a light-emitting control circuit, a light-emitting device and a drive transistor. The data write circuit supplies a data voltage to a first node in response to a scan signal. The reset circuit supplies a reference voltage to a second node in response to the scan signal. The first storage circuit is connected between the second node and the third node. The second storage circuit is connected between the first power supply (Continued)

terminal and the third node. Also disclosed are a display panel, a display apparatus, and a method of driving the pixel circuit.

20 Claims, 17 Drawing Sheets

(56) References Cited

U.S. PATENT DOCUMENTS

| | | | | |
|---|---|---|---|---|
| 2015/0035448 | A1 | 2/2015 | Wang | |
| 2015/0356924 | A1* | 12/2015 | Chen | G09G 3/3258 345/690 |
| 2017/0110055 | A1 | 4/2017 | Li et al. | |
| 2017/0116918 | A1 | 4/2017 | Dong et al. | |

FOREIGN PATENT DOCUMENTS

| | | | |
|---|---|---|---|
| CN | 103247262 | A | 8/2013 |
| CN | 104200771 | A | 12/2014 |
| CN | 104751804 | A | 7/2015 |
| CN | 104809989 | A | 7/2015 |
| CN | 106297663 | A | 1/2017 |
| KR | 20120061522 | A | 6/2012 |
| KR | 20130056507 | A | 6/2013 |

OTHER PUBLICATIONS

First Office Action for Chinese Patent Application No. 201610542193.4 dated Apr. 25, 2017.

Search Report for Chinese Patent Application No. 201610842193.4 dated Feb. 27, 2017.

* cited by examiner

PIXEL CIRCUIT, DISPLAY PANEL, DISPLAY APPARATUS AND DRIVING METHOD

CROSS REFERENCE

This application is the U.S. national phase entry of PCT/CN2017/092964, with an international filing date of Jul. 14, 2017, which claims the benefit of China Patent Application No. 201610842193.4, filed on Sep. 22, 2016, the entire disclosures of which are incorporated herein by reference.

TECHNICAL FIELD

The disclosure relates to the field of display technology, and in particular, to a pixel circuit, a display panel, a display apparatus, and a method of driving the pixel circuit.

BACKGROUND

There have been some problems with organic light-emitting displays. The organic light-emitting diodes (OLEDs) are current-driven devices that require a steady current to control light emission. Drive transistors in the OLED pixel circuits may have different threshold voltages due to e.g. fabrication processes and device aging, resulting in different luminance for the same data signal. This may result in uneven luminance among different display areas.

SUMMARY

According to an aspect of the present disclosure, embodiments of the present disclosure provide a pixel circuit that comprises: a data write circuit connected to a scan line, a data line and a first node and configured to supply a data voltage on the data line to the first node in response to a scan signal on the scan line; a reset circuit connected to the scan line, a reference voltage terminal and a second node and configured to supply a reference voltage from the reference voltage terminal to the second node in response to the scan signal on the scan line; a first storage circuit connected between the second node and a third node and configured to be charged or discharged with a voltage across the second node and the third node; a second storage circuit connected between a first power supply terminal and the third node and configured to be charged or discharged with a voltage across the first power supply terminal and the third node; a light-emitting control circuit connected to a light-emitting control line, the first power supply terminal, the first node, the second node, and the third node and configured to, in response to a control signal on the light-emitting control line, provide a conduction path between the first power supply terminal and the third node and a conduction path between the first node and the second node; and a drive transistor having a gate connected to the first node, a source connected to the third node, and a drain connected to a light-emitting device and configured to drive the light-emitting device to emit light.

In certain exemplary embodiments, the data write circuit comprises a first switch transistor having a gate connected to the scan line, a first electrode connected to the data line, and a second electrode connected to the first node.

In certain exemplary embodiments, the reset circuit comprises a second switch transistor having a gate connected to the scan line, a first electrode connected to the reference voltage terminal, and a second electrode connected to the second node.

In certain exemplary embodiments, the light-emitting control circuit comprises: a third switch transistor having a gate connected to the light-emitting control line, a first electrode connected to the first power supply terminal, and a second electrode connected to the third node; and a fourth switch transistor having a gate connected to the light-emitting control line, a first electrode connected to the second node, and a second electrode connected to the first node.

In certain exemplary embodiments, the first storage circuit comprises a first capacitor having a first terminal connected to the second node and a second terminal connected to the third node.

In certain exemplary embodiments, the second storage circuit comprises a second capacitor having a first terminal connected to the first power supply terminal and a second terminal connected to the third node.

In certain exemplary embodiments, the light-emitting device is an organic light-emitting diode.

In certain exemplary embodiments, the drive transistor is a P-type transistor, and the drain of the drive transistor is connected to an anode of the light-emitting device.

In certain exemplary embodiments, the drive transistor is an N-type transistor, and the drain of the drive transistor is connected to a cathode of the light-emitting device.

According to another aspect of the present disclosure, embodiments of the disclosure provide a display panel comprising: a plurality of scan lines; a plurality of light control lines; a plurality of data lines intersecting the scan lines and the light-emitting control lines; and a plurality of pixel circuits arranged at intersections of the scan lines, the light-emitting control lines, and the data lines. Each of the pixel circuits comprises: a data write circuit connected to a corresponding one of the scan lines, a corresponding one of the data lines, and a first node, the data write circuit being configured to supply a data voltage on the corresponding data line to the first node in response to a scan signal on the corresponding scan line; a reset circuit connected to the corresponding scan line, a reference voltage terminal, and a second node, the reset circuit being configured to supply a reference voltage from the reference voltage terminal to the second node in response to the scan signal on the corresponding scan line; a first storage circuit connected between the second node and a third node, the first storage circuit being configured to be charged or discharged with a voltage across the second node and the third node; a second storage circuit connected between a first power supply terminal and the third node, the second storage circuit being configured to be charged or discharged with a voltage across the first power supply terminal and the third node; a light-emitting control circuit connected to a corresponding one of the light-emitting control lines, the first power supply terminal, the first node, the second node, and the third node, the light-emitting control circuit being configured to, in response to a control signal on the corresponding light-emitting control line, provide a conduction path between the first power supply terminal and the third node and a conduction path between the first node and the second node; a light-emitting device having a first terminal and a second terminal connected to a second power supply terminal; and a drive transistor having a gate connected to the first node, a source connected to the third node, and a drain connected to the first terminal of the light-emitting device, the drive transistor being configured to drive the light-emitting device to emit light.

According to yet another aspect of the present disclosure, embodiments of the disclosure provide a display apparatus comprising the display panel as described above.

According to still yet another aspect of the present disclosure, embodiments of the disclosure provide a method of driving the pixel circuit as described above. The method comprises: during a first phase, providing, by the light-emitting control circuit, the conduction path between the first power supply terminal and the third node and the conduction path between the first node and the second node; during a second phase, supplying, by the data write circuit, the data voltage on the data line to the first node and supplying, by the reset circuit, the reference voltage from the reference voltage terminal to the second node such that the first storage circuit and the second storage circuit are charged or discharged until a potential at the third node is equal to a value obtained by subtracting a threshold voltage of the drive transistor from the data voltage; and during a third phase, providing, by the light-emitting control circuit, the conduction path between the first power supply terminal and the third node and the conduction path between the first node and the second node such that the drive transistor drives the light-emitting device to emit light.

In certain exemplary embodiments, the method further comprises: subsequent to the second phase and prior to the third phase, holding the voltage across the second node and the third node by floating the second node.

These and other aspects of the present disclosure will be apparent from and elucidated with reference to the embodiment(s) described hereinafter.

DETAILED DESCRIPTION

In order to render the objectives, features and advantages of the present disclosure more comprehensible, the embodiments of the present disclosure are described in detail below with reference to the accompanying drawings.

It will be understood that, although the terms first, second, third etc. may be used herein to describe various elements, components and/or sections, these elements, components and/or sections should not be limited by these terms. These terms are only used to distinguish one element, component, or section from another. Thus, a first element, component or section discussed below could be termed a second element, component or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected to" or "coupled to" another element, it can be directly connected or coupled to the other element, or intervening elements may be present. In contrast, when an element is referred to as being "directly connected to" or "directly coupled to" another element, there are no intervening elements present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 1A:
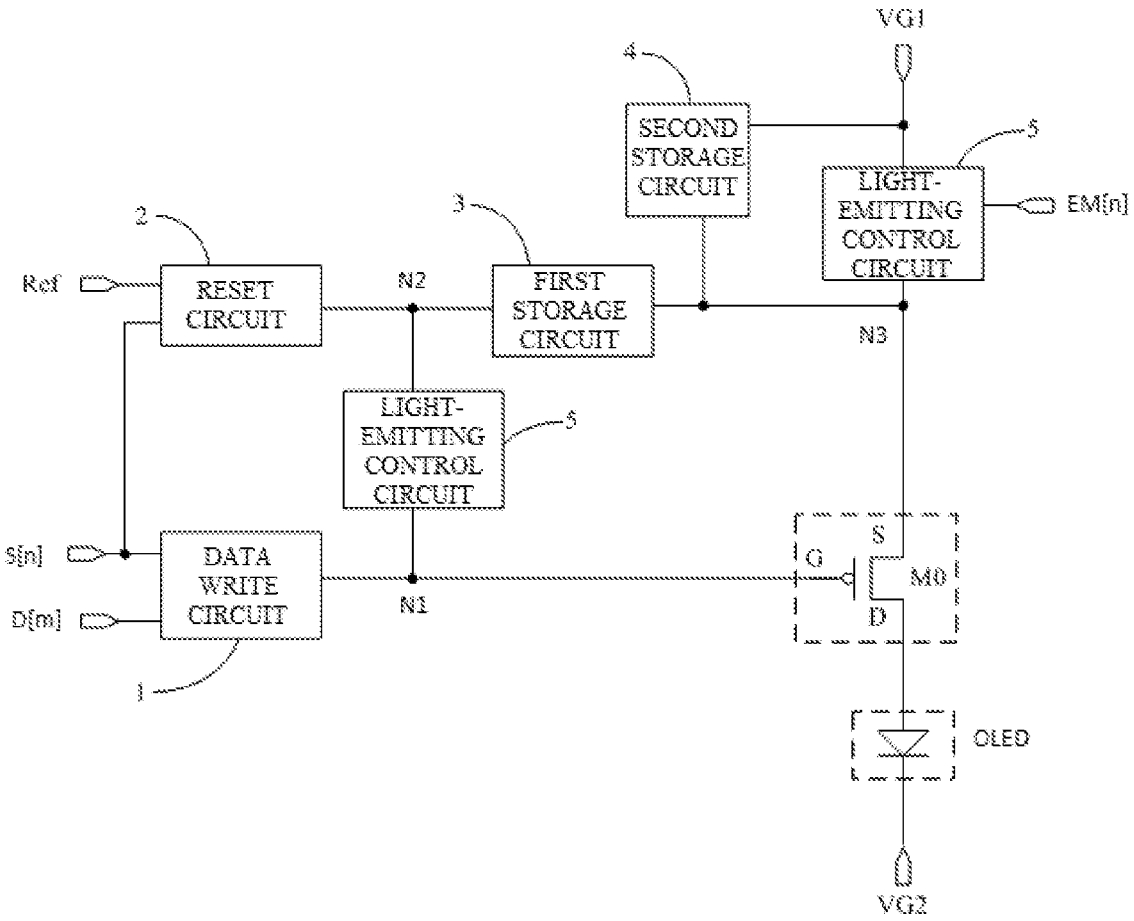
FIG. 1A is a schematic diagram of a pixel circuit according to an embodiment of the present disclosure.

FIG. 1A is a schematic diagram of a pixel circuit according to an embodiment of the present disclosure. As shown in FIG. 1A, the pixel circuit includes a data write circuit 1, a reset circuit 2, a first storage circuit 3, a second storage circuit 4, a light-emitting control circuit 5, and a drive transistor M0. The drive transistor M0 is connected to the light-emitting device OLED to drive it to emit light. For the purpose of illustration, the light-emitting control circuit 5 is shown as two separate blocks, both of which are labeled with the same reference numeral "5".

The data write circuit 1 is connected to a scan line S[n], a data line D[m], and a first node N1. Specifically, the data write circuit 1 has a first terminal connected to the scan line S[n], a second terminal connected to the data line D[m], and a third terminal connected to the first node N1. The data write circuit 1 may supply a data voltage on the data line D[m] to the first node N1 in response to a scan signal on the scan line S[n].

The reset circuit 2 is connected to the scan line S[n], a reference voltage terminal Ref, and a second node N2. Specifically, the reset circuit 2 has a first terminal connected to the scan line S[n], a second terminal connected to the reference signal terminal Ref, and a third terminal connected to the second node N2. The reset circuit 2 may supply a reference voltage from the reference voltage terminal Ref to the second node N2 in response to the scan signal on the scan line S[n].

The first storage circuit 3 is connected between the second node N2 and a third node N3. Specifically, the first storage circuit 3 has a first terminal connected to the second node N2 and a second terminal connected to the third node N3. The first storage circuit 3 may be charged or discharged with a voltage across the second node N2 and the third node N3. As will be described later, when the second node N2 is in a floated state, the first storage circuit 3 may maintain the voltage across the second node N2 and the third node N3.

The second storage circuit 4 is connected between a first power supply terminal VG1 and the third node N3. Specifically, the second storage circuit 4 has a first terminal connected to the first power supply terminal VG1 and a second terminal connected to the third node N3. The second storage circuit 4 may be charged or discharged with a voltage across the first power supply terminal VG1 and the third node N3.

The light-emitting control circuit 5 is connected to a light-emitting control line EM[n], the first power supply terminal VG1, the first node N1, the second node N2, and the third node N3. Specifically, the light-emitting control circuit 5 has a first terminal connected to the light-emitting control line EM[n], a second terminal connected to the first power supply terminal VG1, a third terminal connected to the first node N1, a fourth terminal connected to the second node N2, and a fifth terminal connected to the third node N3. The light-emitting control circuit 5 may provide a conduction path between the first power supply terminal VG1 and the third node N3 and a conduction path between the first node N1 and the second node N2 in response to a control signal on the light-emitting control line EM[n].

The light-emitting device (shown as an OLED) has a first terminal and a second terminal that is connected to a second power terminal VG2. It is to be understood that although the light-emitting device is illustrated herein as an OLED, any existing or future light-emitting device may be employed.

The drive transistor M0 has a gate connected to the first node N1, a source connected to the third node N3, and a drain connected to the first terminal of the light-emitting device OLED. The drive transistor M0 may generate a driving current to drive the light-emitting device OLED to emit light. Specifically, the drive transistor M0 may control the amount of current supplied to the light-emitting device OLED based on the voltage across the first node N1 and the third node N3.

In this embodiment, the drive transistor M0 is a P-type transistor, which typically has a negative threshold voltage. The driving current generated by the drive transistor M0 to drive the light-emitting device OLED to emit light flows from the source S to the drain D of the drive transistor M0. In this case, the voltage of the first power supply terminal VG1 typically has a positive value, and the voltage of the second power terminal VG2 typically has a ground level or a negative value. In addition, the first terminal of the light-emitting device OLED is an anode, and the second terminal of the light-emitting device OLED is a cathode.

Figure 1B:
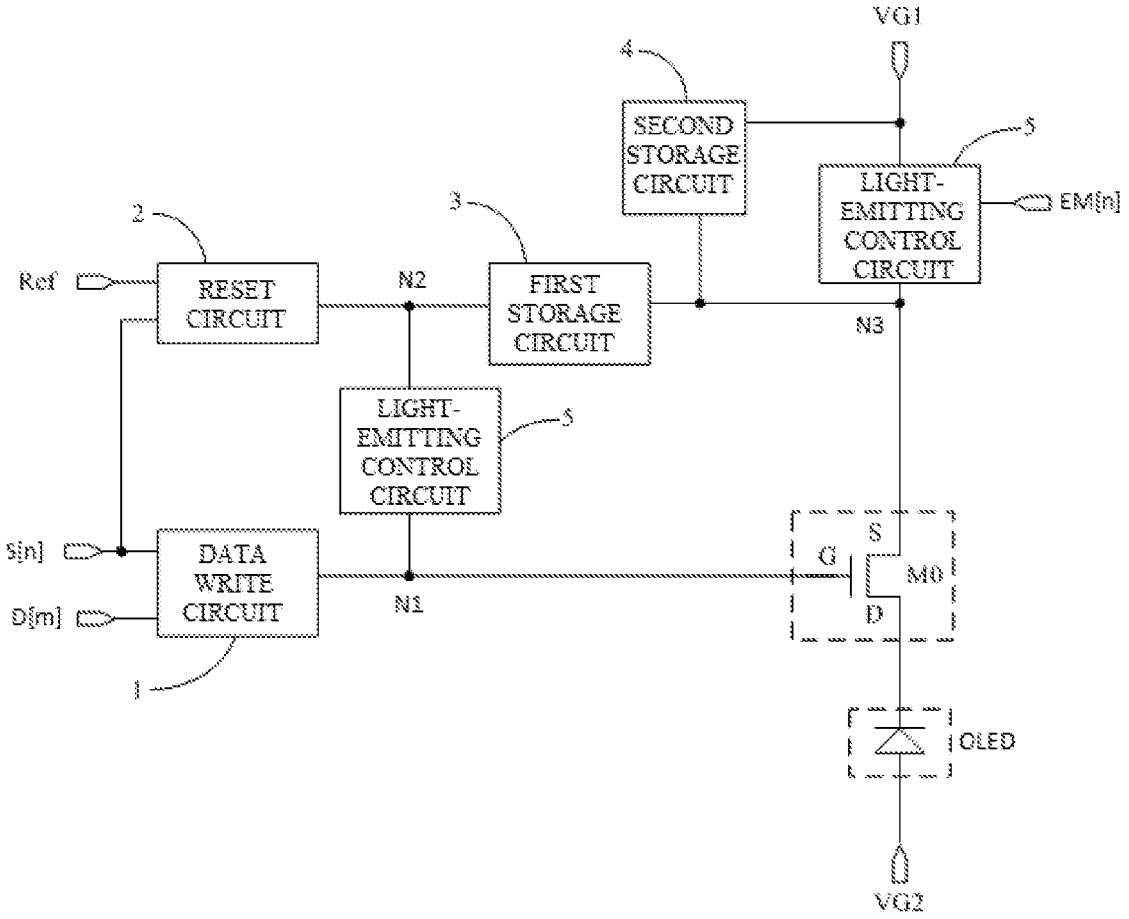
FIG. 1B is a schematic diagram of a pixel circuit according to another embodiment of the present disclosure.

FIG. 1B is a schematic diagram of a pixel circuit according to another embodiment of the present disclosure. This pixel circuit has a configuration similar to the embodiment of FIG. 1A except that the drive transistor M0 is an N-type transistor, which typically has a positive threshold voltage. The driving current generated by the drive transistor M0 to drive the light-emitting device OLED emits light from the drain D to the source S of the drive transistor M0. In this case, the voltage of the first power supply terminal VG1 typically has a ground level or a negative value, and the voltage of the second power terminal VG2 typically has a positive value. In addition, the first terminal of the light-emitting device OLED is a cathode, and the second terminal of the light-emitting device OLED is an anode.

Figure 2A:
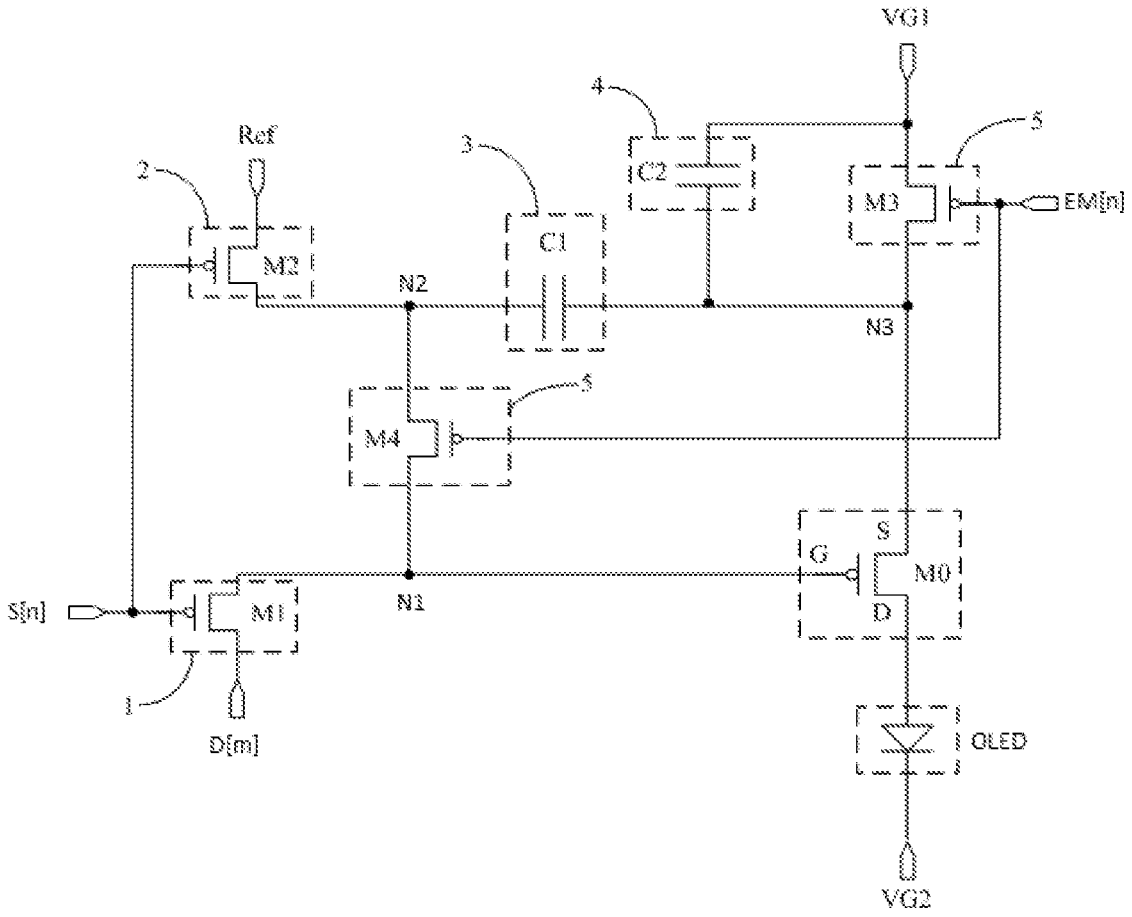
FIG. 2A shows an example of the pixel circuit shown in FIG. 1A.

FIG. 2A shows an example of the pixel circuit shown in FIG. 1A. As shown in FIG. 2A, the data write circuit 1 includes a first switch transistor M1, the reset circuit 2 includes a second switch transistor M2, the first storage circuit 3 includes a first capacitor C1, the second storage circuit 4 includes a second capacitor C2, and the light-emitting control circuit 5 includes a third switch transistor M3 and a fourth switch transistor M4.

The first switch transistor M1 has a gate connected to the scan line S[n], a first electrode connected to the data line D[m], and a second electrode connected to the first node N1. In this example, the first switch transistor M1 is a P-type transistor.

The second switch transistor M2 has a gate connected to the scan line S[n], a first electrode connected to the reference voltage terminal Ref, and a second electrode connected to the second node N2. In this example, the second switch transistor M2 is a P-type transistor.

The third switch transistor M3 has a gate connected to the light-emitting control line EM[n], a first electrode connected to the first power supply terminal VG1, and a second electrode connected to the third node N3.

The fourth switch transistor M4 has a gate connected to the light-emitting control line EM[n], a first electrode connected to the second node N2, and a second electrode connected to the first node N1. In this example, the third switch transistor M3 and the fourth switch transistor M4 are P-type transistors.

The first capacitor C1 has a first terminal connected to the second node N2 and a second terminal connected to the third node N3.

The second capacitor C2 has a first terminal connected to the first power supply terminal VG1 and a second terminal connected to the third node N3.

In the example of FIG. 2A, the switch transistors M1, M2, M3, and M4 and the drive transistor M0 are all P-type transistors. This may simplify the fabrication of pixel circuits because all transistors can be made with substantially the same process.

Figure 2B:
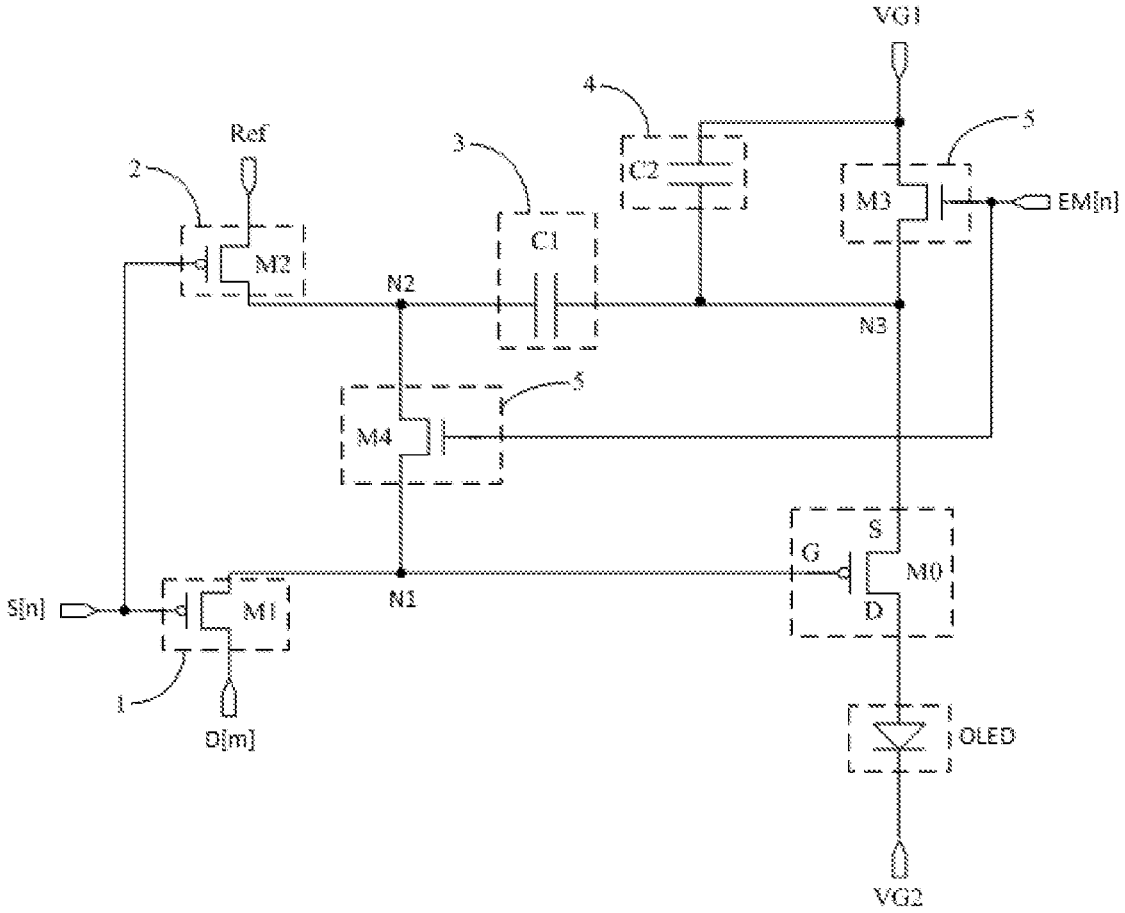
FIG. 2B shows another example of the pixel circuit shown in FIG. 1A.

FIG. 2B shows another example of the pixel circuit shown in FIG. 1A. This pixel circuit has a configuration similar to the example of FIG. 2A except that the third switch transistor M3 and the fourth switch transistor M4 are N-type transistors.

Figure 3A:
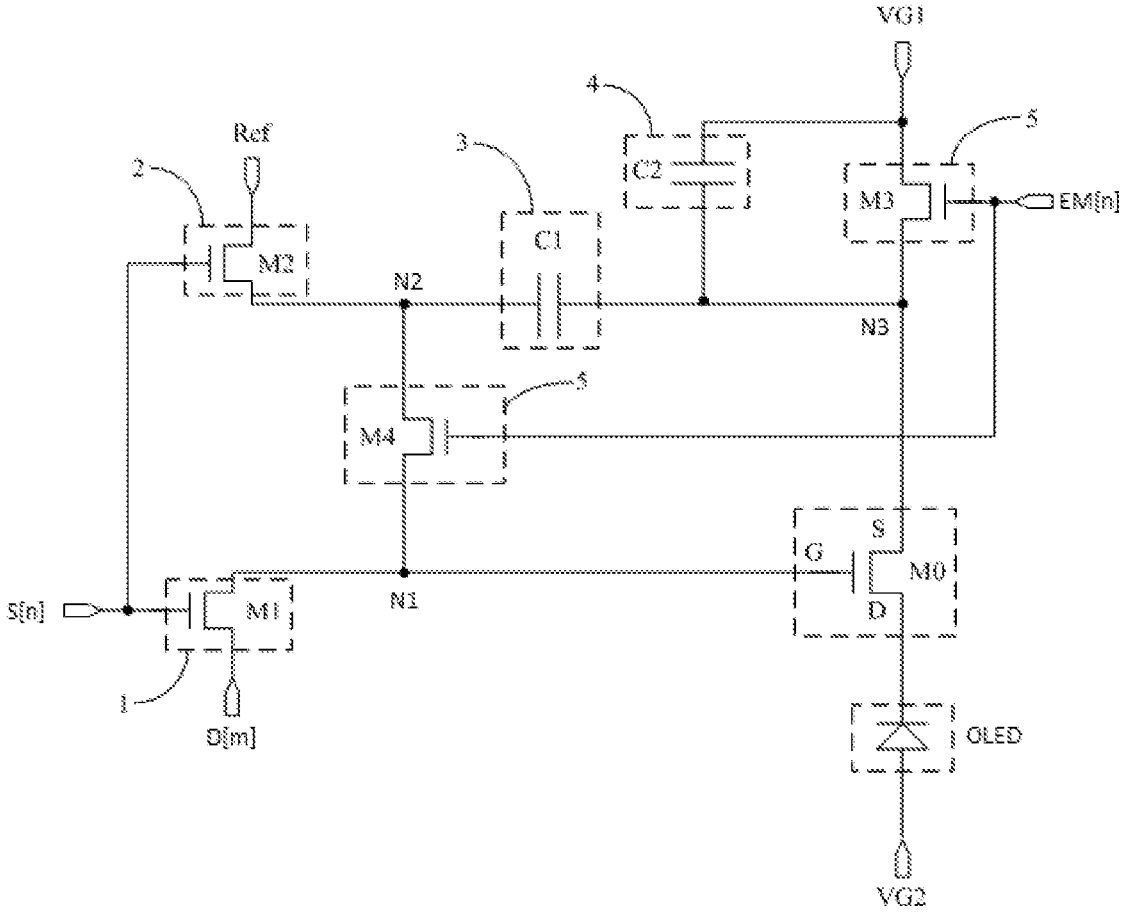
FIG. 3A shows an example of the pixel circuit shown in FIG. 1B.

FIG. 3A shows an example of the pixel circuit shown in FIG. 1B. In this example, the switch transistors M1, M2, M3, and M4 and the drive transistor M0 are all N-type transistors. This may simplify the fabrication of pixel circuits because all transistors can be made with substantially the same process.

Figure 3B:
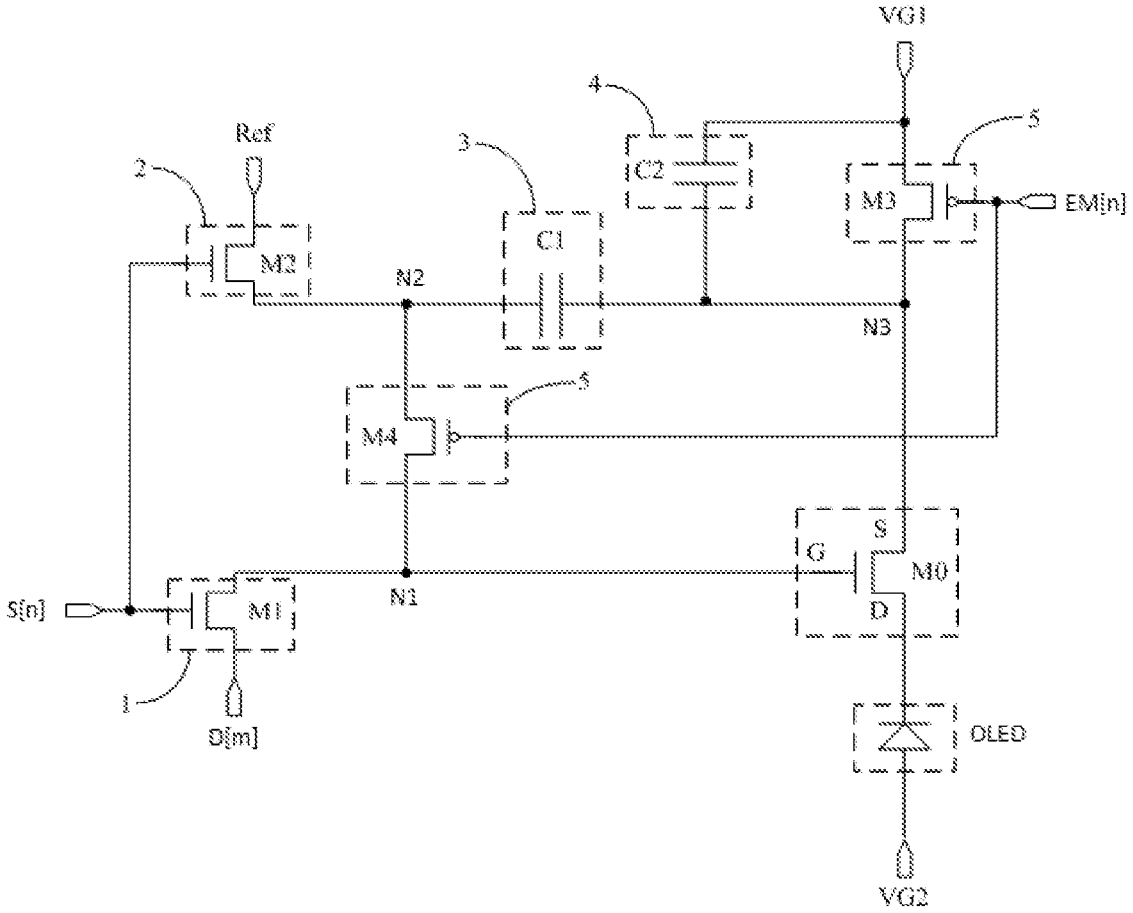
FIG. 3B shows another example of the pixel circuit shown in FIG. 1B.

FIG. 3B shows another example of the pixel circuit shown in FIG. 1B. The pixel circuit has a configuration similar to the example of FIG. 3A except that the third switch transistor M3 and the fourth switch transistor M4 are P-type transistors.

In various embodiments, the drive transistor M0 and the switch transistors M1, M2, M3, and M4 may be thin film transistors or metal oxide semiconductor field effect transistors. In particular, the switch transistors M1, M2, M3, and M4 are typically fabricated such that their sources and drains can be used interchangeably.

Figure 4A:
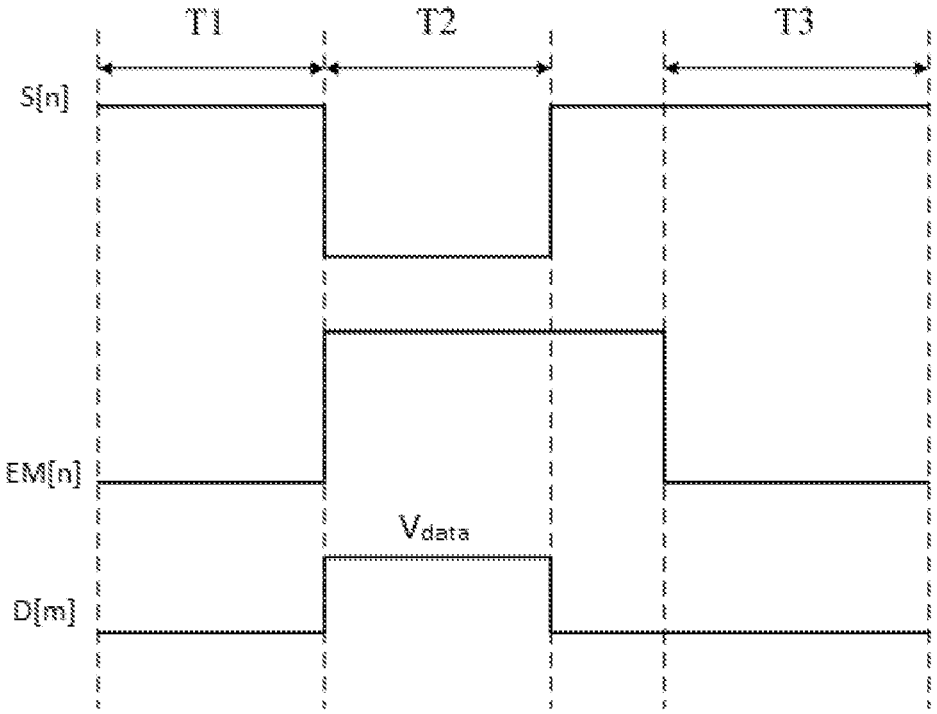
FIG. 4A is a timing diagram for the pixel circuit shown in FIG. 2A.
Figure 4B:
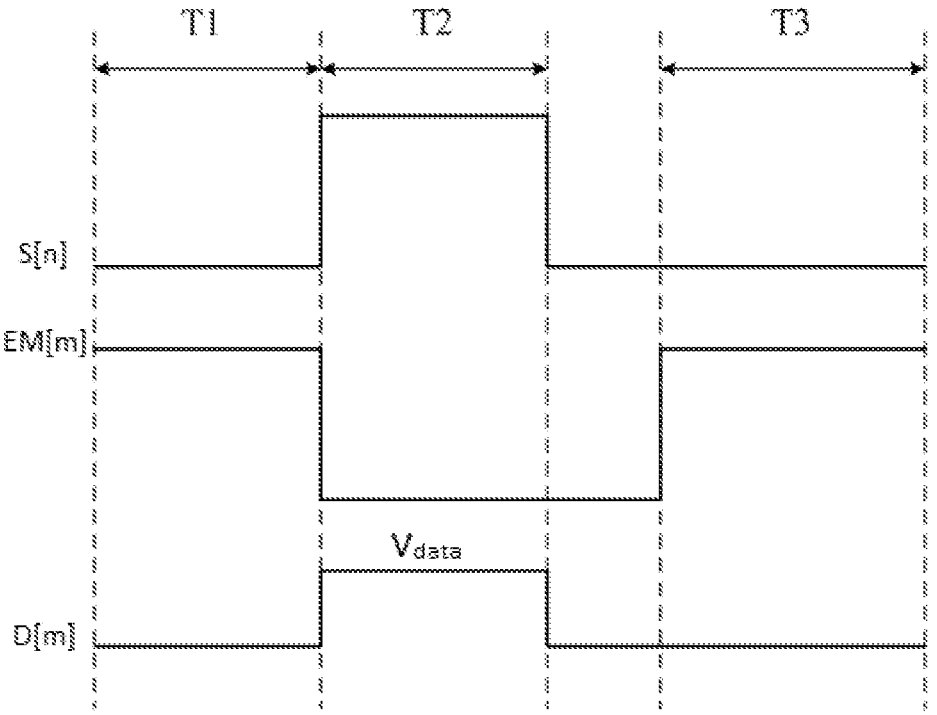
FIG. 4B is a timing diagram for the pixel circuit shown in FIG. 3A.

FIGS. 4A and 4B are timing diagrams of the pixel circuits shown in FIGS. 2A and 3A, respectively. The operation of the example pixel circuits will be described below in conjunction with these timing diagrams. Hereinafter, a high level is indicated by "1", and a low level by "0".

For the example pixel circuit of FIG. 2A, it is assumed that:

$$V_{Ref}=V_{data}(\text{min}); \text{ and}$$

$$\frac{c1\cdot V_{Ref}}{c1+c2}+\frac{c2(V_{g1}-|V_{th}|)}{c1+c2}>V_{data}(\text{max}),$$

where $V_{Ref}$ represents the reference voltage of the reference signal terminal Ref, $V_{data}$ (min) represents the minimum data voltage on the data line D[m], $V_{data}$ (max) represents the maximum voltage on the data line D[m], c1 represents the capacitance of the first capacitor C1, c2 represents the capacitance of the second capacitor C2, $V_{g1}$ represents the voltage of the first power supply terminal VG1, and $V_{th}$ represents the threshold voltage of the drive transistor M0.

Figure 5A:
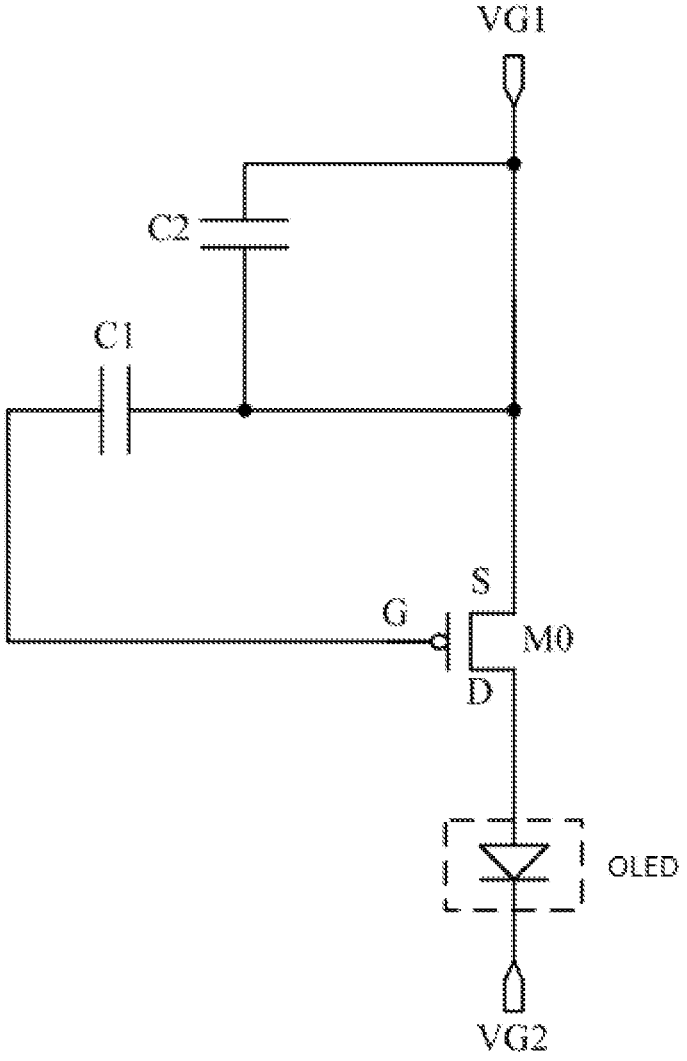
FIG. 5A is an equivalent circuit diagram of the pixel circuit shown in FIG. 2A during a first phase.

During phase T1, S[n]=1 and EM[n]=0. The equivalent circuit is shown in FIG. 5A.

As S[n]=1, both the first switch transistor M1 and the second switch transistor M2 are turned off. As EM[n]=0, both the third switch transistor M3 and the fourth switch transistor M4 are turned on. The turned-on fourth switch transistor M4 brings the first node N1 and the second node N2 into conduction. The turned-on third switch transistor M3 brings the first power supply terminal VG1 and the third node N3 into conduction, supplying the voltage $V_{g1}$ of the first power supply terminal VG1 to the third node N3.

Figure 5B:
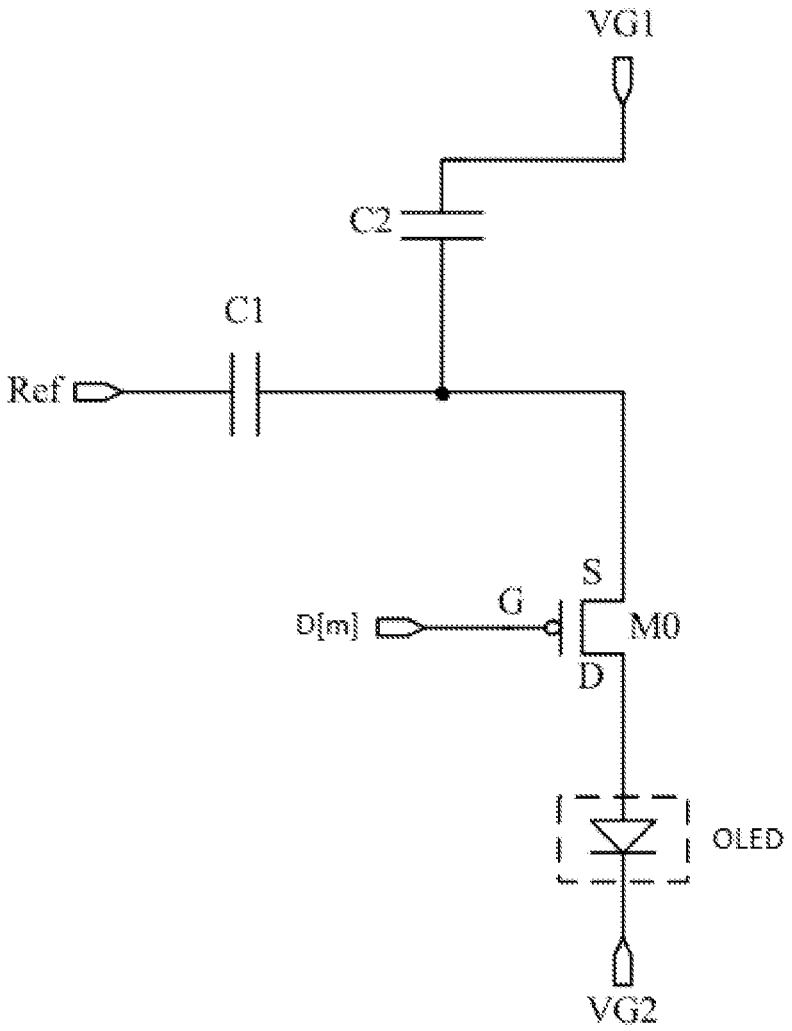
FIG. 5B is an equivalent circuit diagram of the pixel circuit shown in FIG. 2A during a second phase.

During phase T2, S[n]=0 and EM[n]=1. The equivalent circuit is shown in FIG. 5B.

As S[n]=0, both the first switch transistor M1 and the second switch transistor M2 are turned on. As EM[n]=1, both the third switch transistor M3 and the fourth switch transistor M4 are turned off. The turned-on second switch transistor M2 supplies the reference voltage VRef of the reference voltage terminal Ref to the second node N2. The turned-on first switch transistor M1 supplies the data voltage $V_{data}$ on the data line D[m] to the first node N1. Although affected by a transition of the potential of the second node N2, the potential of the third node N3 can still make the gate-source voltage of the drive transistor M0 less than its threshold voltage $V_{th}$. Therefore, the drive transistor M0 is turned on so that the first capacitor C1 and the second capacitor C2 are discharged through the drive transistor M0 until the potential of the third node N3 drops to $V_{data}-V_{th}$. At this time, the drive transistor M0 is in a critical state between turn-on and turn-off, and the voltage across the first capacitor C1 is $V_{data}-V_{th}-V_{Ref}$. The discharge current has such a short duration that the light emission of the light-emitting device OLED is not perceived.

Figure 5C:
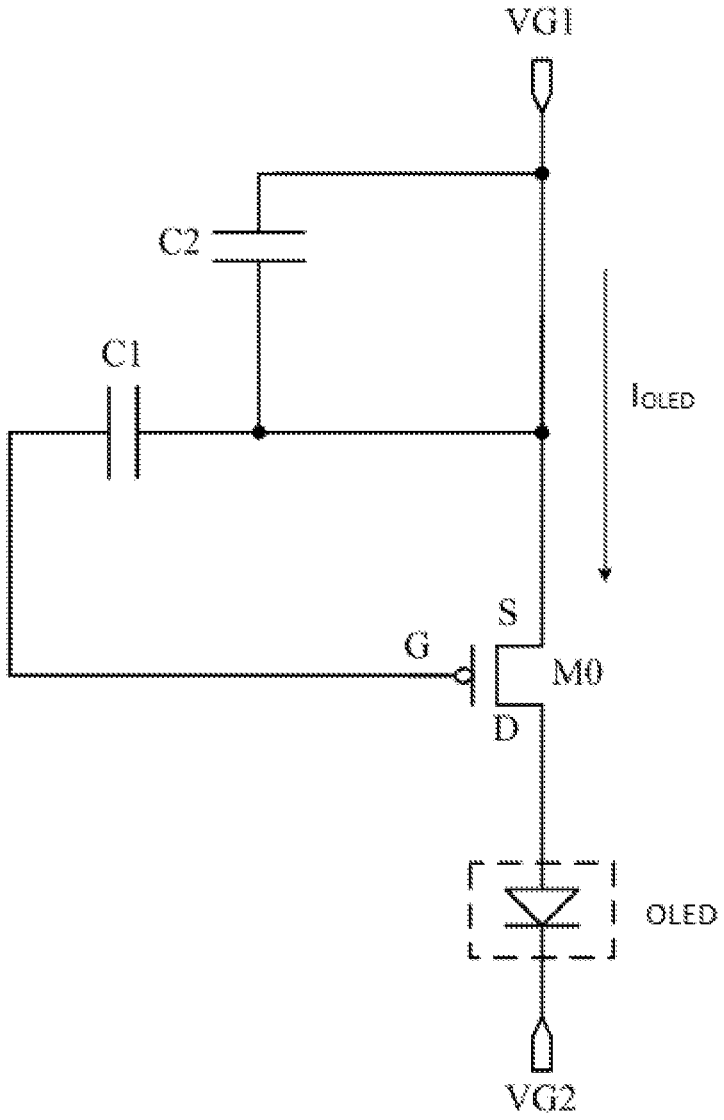
FIG. 5C is an equivalent circuit diagram of the pixel circuit shown in FIG. 2A during a third phase.

In phase T3, S[n]=1 and EM[n]=0. The equivalent circuit is shown in FIG. 5C.

As S[n]=1, both the first switch transistor M1 and the second switch transistor M2 are turned off. As EM[n]=0, both the third switch transistor M3 and the fourth switch transistor M4 are turned on. The turned-on third switch transistor M3 supplies the voltage $V_{g1}$ of the first power supply terminal VG1 to the third node N3. The turned-on fourth switch transistor M4 brings the first node N1 and the second node N2 into conduction. As the first node N1 and the second node N2 are in a floated state, the voltage across the first capacitor C1 is still $V_{data}-V_{th}-V_{Ref}$. Therefore, the gate-source voltage of the drive transistor M0 is the voltage across the first capacitor C1, i.e., $V_{data}-V_{th}-V_{Ref}$. The drive transistor M0 is in a saturated state, and the driving current $I_{OLED}$ flowing through the drive transistor M0 satisfies the formula:

$$I_{OLED}=K(V_{SG}+V_{th})^2=K[(V_{data}-V_{th}-V_{Rref})+V_{th}]^2=K(V_{data}-V_{Ref})^2,$$

where $V_{SG}$ is the source-gate voltage of the drive transistor M0, and K is a structural parameter, which can be regarded as a constant.

It can be seen from the above equation that the driving current $I_{OLED}$ flowing through the drive transistor M0 is only related to the reference voltage $V_{Ref}$ and the data voltage $V_{data}$, being independent of the threshold voltage $V_{th}$ of the drive transistor M0. Therefore, the influence of the drift of the threshold voltage $V_{th}$ on the luminance of the light-emitting device OLED is eliminated, thereby improving luminance uniformity. Moreover, the driving current $I_{OLED}$ is also independent of the voltage $V_{g1}$ of the first power supply terminal VG1, so that the influence of the voltage drop on the power line on the luminance of the light-emitting device OLED can be avoided.

Figure 5D:
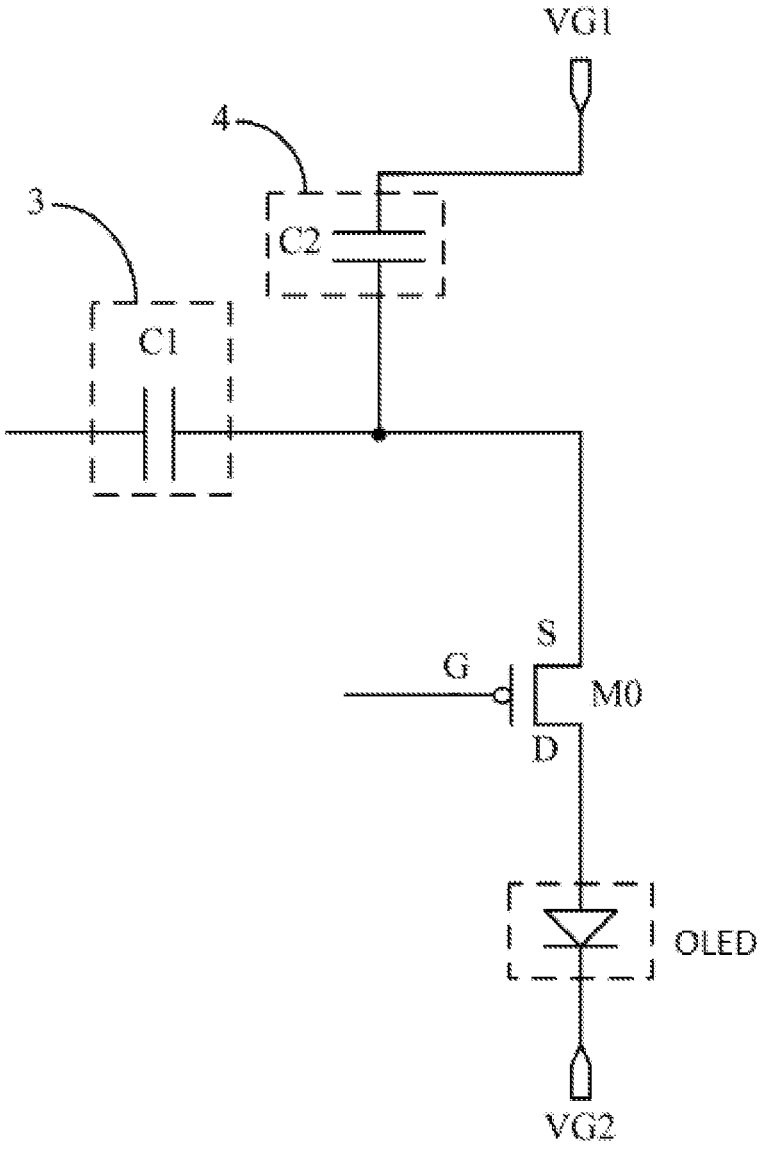
FIG. 5D is an equivalent circuit diagram of the pixel circuit shown in FIG. 2A during a buffering phase.

A buffering phase in which S[n]=1 and EM[n]=1 may also be included between phase T2 and phase T3. The equivalent circuit is shown in FIG. 5D. The first switch transistor M1 to the fourth switch transistor M4 are all turned off so that the voltage across the first capacitor C1 is maintained at $V_{data}-V_{th}-V_{Ref}$, thereby preventing the impact on the pixel circuit caused by the simultaneous transition of the scan signal on the scan line S[n] and the control signal on the light-emitting control line EM[n].

For the example pixel circuit of FIG. 3A, it is assumed that:

$$V_{Ref}=V_{Data}(\text{max}); \text{ and}$$

$$\frac{c1\cdot V_{Ref}}{c1+c2}+\frac{c2(V_{g1}+V_{th})}{c1+c2}<V_{data}(\text{min}),$$

where $V_{Ref}$ represents the reference voltage of the reference signal terminal Ref, $V_{data}$ (min) represents the minimum data voltage on the data line D[m], $V_{data}$ (max) represents the maximum voltage on the data line D[m], c1 represents the capacitance of the first capacitor C1, c2 represents the capacitance of the second capacitor C2, $V_{g1}$ represents the voltage of the first power supply terminal VG1, and $V_{th}$ represents the threshold voltage of the drive transistor M0.

Figure 6A:
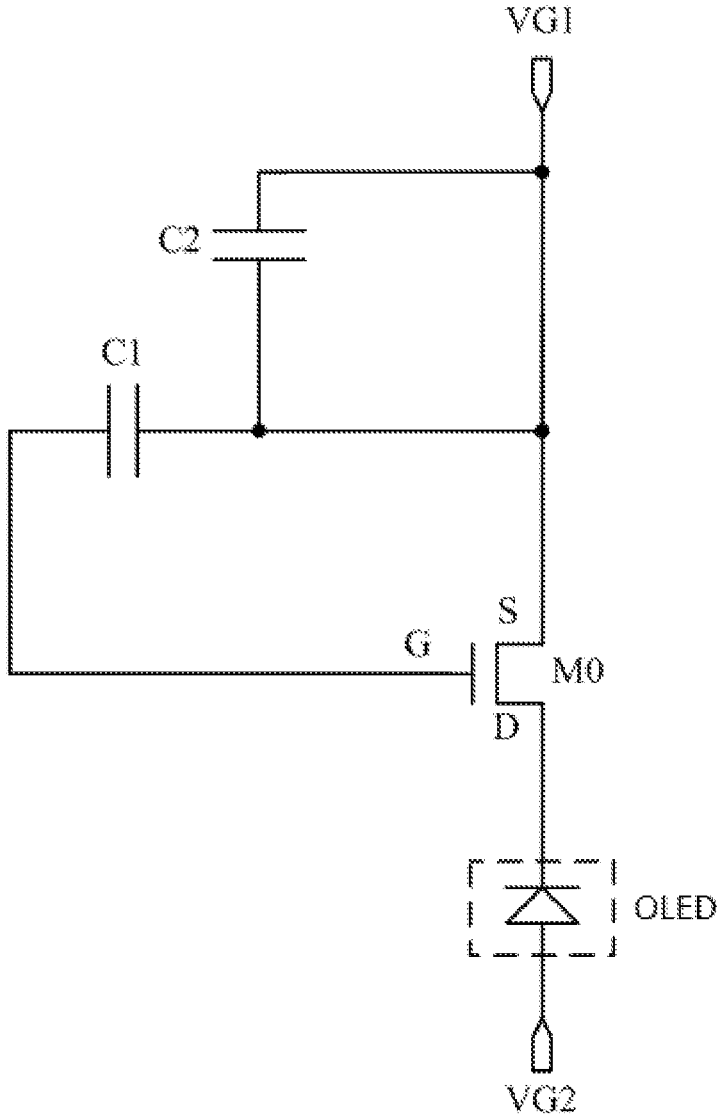
FIG. 6A is an equivalent circuit diagram of the pixel circuit shown in FIG. 3A during a first phase.

In phase T1, S[n]=0 and EM[n]=1. The equivalent circuit is shown in FIG. 6A. As S[n]=0, both the first switch transistor M1 and the second switch transistor M2 are turned off. As EM[n]=1, both the third switch transistor M3 and the fourth switch transistor M4 are turned on. The turned-on fourth switch transistor M4 brings the first node N1 and the second node N2 into conduction. The turned-on third switch transistor M3 brings the first power supply terminal VG1 and the third node N3 into conduction and supplies the voltage $V_{g1}$ of the first power supply terminal VG1 to the third node N3.

Figure 6B:
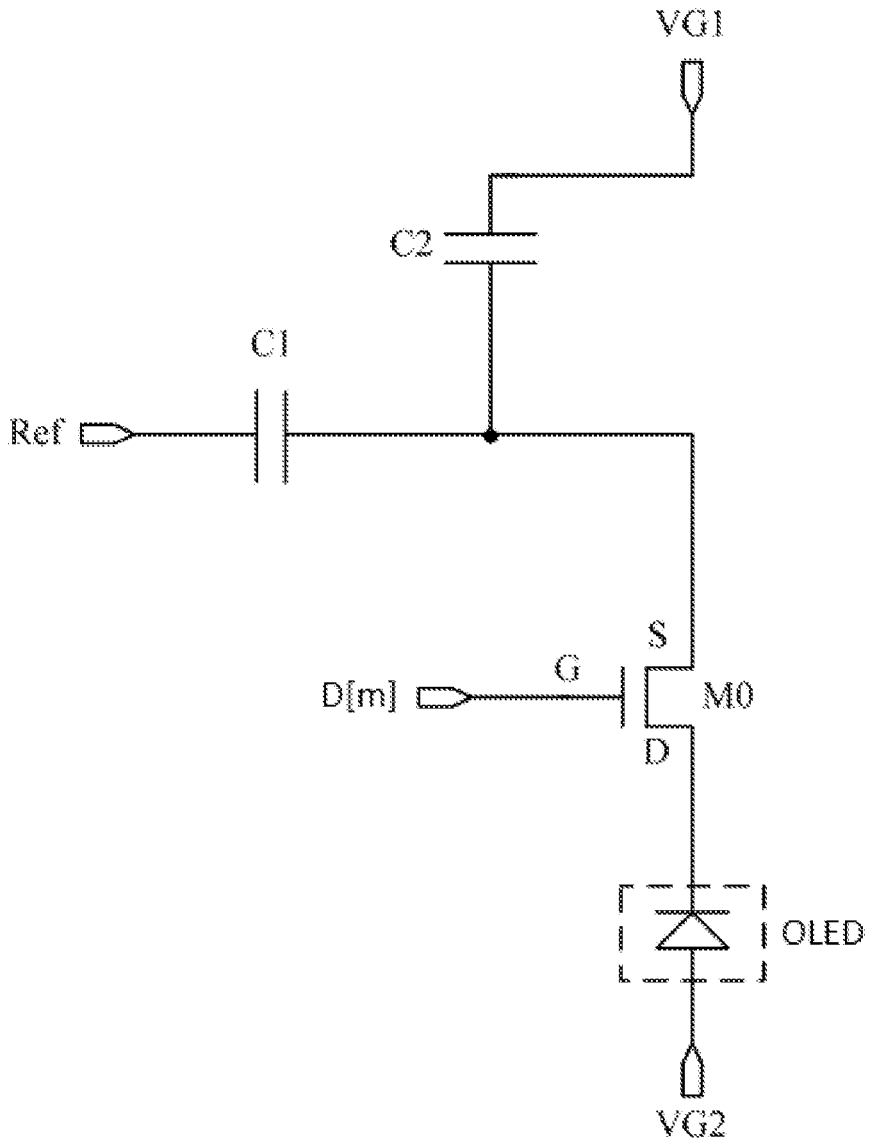
FIG. 6B is an equivalent circuit diagram of the pixel circuit shown in FIG. 3A during a second phase.

In phase T2, S[n]=1 and EM[n]=0. The equivalent circuit is shown in FIG. 6B.

As S[n]=1, both the first switch transistor M1 and the second switch transistor M2 are turned on. As EM[n]=0, both the third switch transistor M3 and the fourth switch transistor M4 are turned off. The turned-on second switch transistor M2 supplies the reference voltage $V_{Ref}$ of the reference voltage terminal Ref to the second node N2. The turned-on first switch transistor M1 supplies the data voltage $V_{data}$ on the data line D[m] to the first node N1. Although affected by the transition of the potential of the second node N2, the potential of the third node N3 can still make the gate-source voltage of the drive transistor M0 greater than the threshold voltage $V_{th}$ thereof. Therefore, the drive transistor M0 is turned on so that the first capacitor C1 and the second capacitor C2 are charged through the drive transistor M0 until the potential of the third node N3 rises to $V_{data}-V_{th}$. At this time, the drive transistor M0 is in a critical state between turn-on and turn-off, and the voltage across the first capacitor C1 is $V_{Ref}-V_{data}+V_{th}$. The charging current has such a short duration that the light emission of the light-emitting device OLED is not perceived.

Figure 6C:
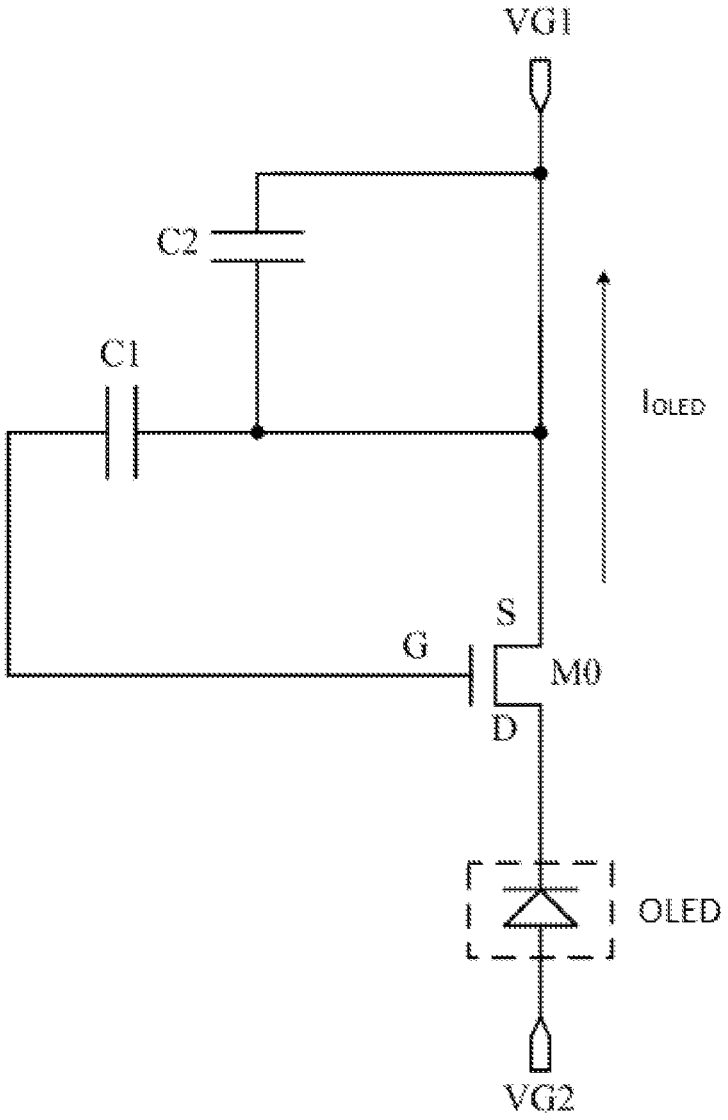
FIG. 6C is an equivalent circuit diagram of the pixel circuit shown in FIG. 3A during a third phase.

In phase T3, S[n]=0 and EM[n]=1. The equivalent circuit is shown in FIG. 6C. As S[n]=0, both the first switch transistor M1 and the second switch transistor M2 are turned off. As EM[n]=1, both the third switch transistor M3 and the fourth switch transistor M4 are turned on. The turned-on third switch transistor M3 supplies the voltage $V_{g1}$ of the first power supply terminal VG1 to the third node N3. The turned-on fourth switch transistor M4 brings the first node N1 and the second node N2 into conduction. As the first node N1 and the second node N2 are in a floated state, the voltage across the first capacitor C1 is still $V_{Ref}-V_{data}+V_{th}$. Therefore, the gate-source voltage of the drive transistor M0 is the voltage $V_{Ref}-V_{data}+V_{th}$ across the first capacitor C1. The drive transistor M0 is in a saturated state, and the driving current $I_{OLED}$ flowing through the drive transistor M0 satisfies the formula:

$$I_{OLED}=K(V_{GS}-V_{th})^2=K[(V_{Ref}-V_{data}+V_{th})-V_{th}]^2=K(V_{Ref}-V_{data})^2,$$

where $V_{GS}$ is the gate-source voltage of the drive transistor M0, and K is a structural parameter, which can be regarded as a constant.

It can be seen from the above equation that the driving current $I_{OLED}$ flowing through the drive transistor M0 is only related to the reference voltage $V_{Ref}$ and the data voltage $V_{data}$, being independent of the threshold voltage $V_{th}$ of the drive transistor M0. Therefore, the influence of the drift of the threshold voltage $V_{th}$ on the luminance of the light-emitting device OLED is eliminated, thereby improving luminance uniformity. Moreover, the driving current $I_{OLED}$ is also independent of the voltage $V_{g1}$ of the first power supply terminal VG1, so that the influence of the voltage drop on the power line on the luminance of the light-emitting device OLED can be avoided.

Figure 6D:
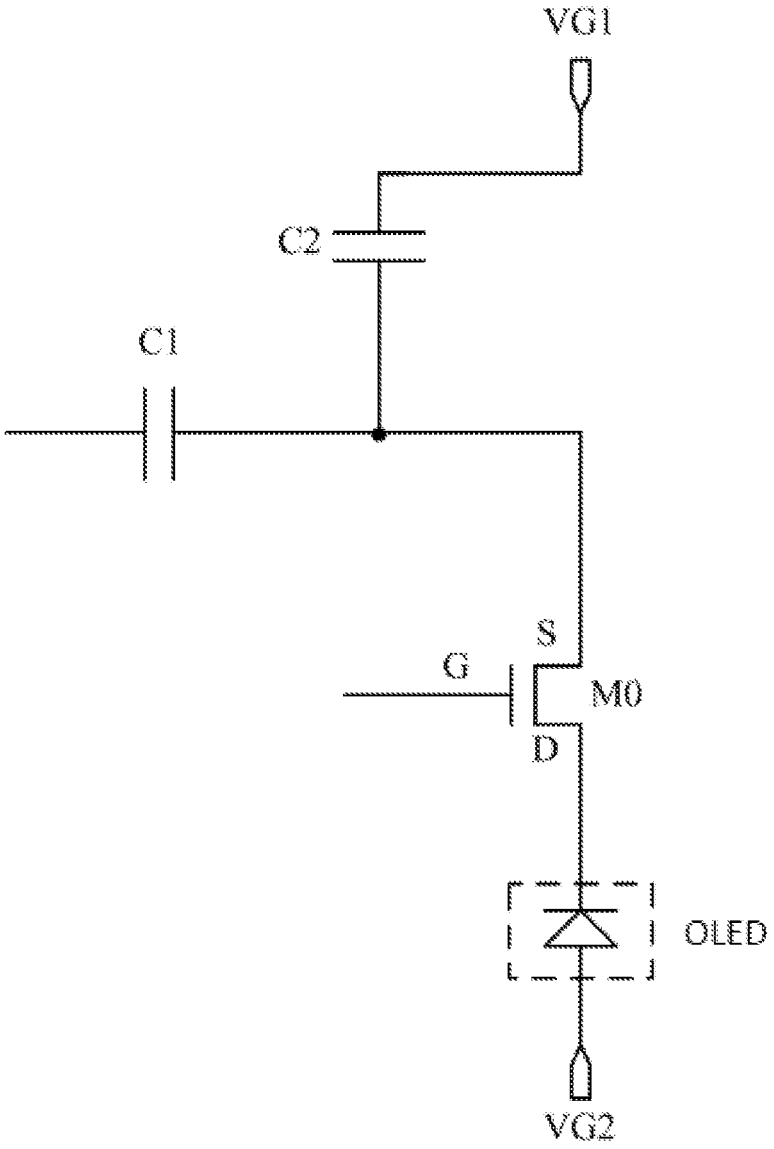
FIG. 6D is an equivalent circuit diagram of the pixel circuit shown in FIG. 3A during a buffering phase.

Between phases T2 and T3 can also be included a buffering phase where S[n]=0 and EM[n]=0. The equivalent circuit is shown in FIG. 6D. The first switch transistor M1 to the fourth switch transistor M4 are all turned off so that the voltage across the first capacitor C1 is maintained at $V_{Ref}-V_{data}+V_{th}$, thus preventing the impact on the pixel circuit caused by the simultaneous transition of the scan signal on the scan line S[n] and the control signal on the light-emitting control line EM[n].

Figure 7:
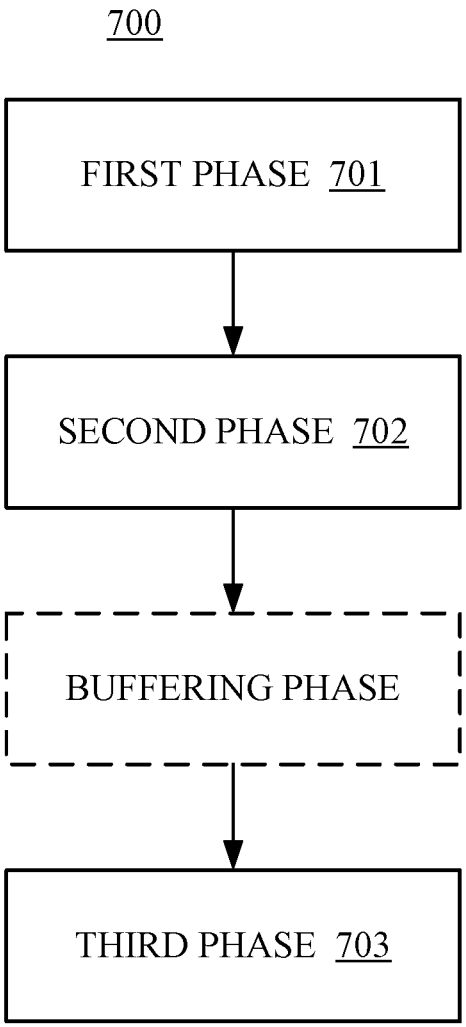
FIG. 7 is a flowchart of a method of driving a pixel circuit according to an embodiment of the present disclosure.

FIG. 7 is a flowchart of a method 700 of driving a pixel circuit according to an embodiment of the present disclosure.

A first phase is performed at step 701. The light-emitting control circuit provides the conduction path between the first power supply terminal and the third node and the conduction path between the first node and the second node.

A second phase is performed at step 702. The data write circuit supplies the data voltage on the data line to the first node and the reset circuit supplies the reference voltage from the reference voltage terminal to the second node. The first storage circuit and the second storage circuit are charged or discharged until the potential at the third node is equal to a value obtained by subtracting the threshold voltage of the drive transistor from the data voltage.

A third phase is performed at step 703. The light-emitting control circuit provides the conduction path between the first power supply terminal and the third node and the conduction path between the first node and the second node.

The drive transistor supplies a current to the light-emitting device based on the voltage across the first node and the third node to drive the light-emitting device to emit light.

When displaying the first frame of images, the pixel circuit performs the first phase, the second phase, and the third phase in sequence. When an image other than the first frame is displayed, the third phase for the previous frame may be reused as the first phase for the current frame, thereby reducing the complexity of the timing.

In certain exemplary embodiments, after the second phase and prior to the third phase, the method 700 may further include a buffering phase where the second node is floated to maintain the voltage across the second node and the third node.

Figure 8:
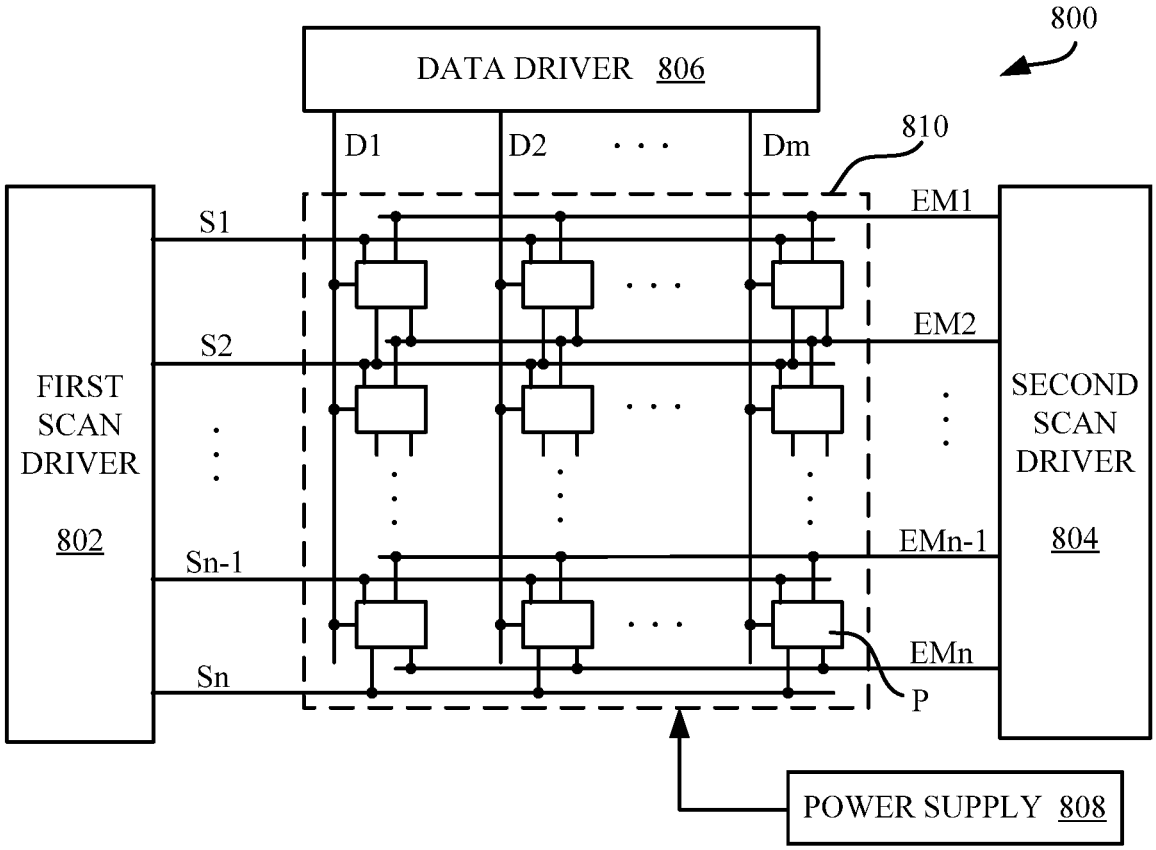
FIG. 8 is a schematic block diagram of a display apparatus according to an embodiment of the present disclosure.

FIG. 8 is a schematic block diagram of a display apparatus 800 according to an embodiment of the present disclosure. Referring to FIG. 8, the display 800 includes a display panel 810, a first scan driver 802, a second scan driver 804, a data driver 806, and a power supply 808.

The display panel 810 includes n×m pixel circuits P. Each pixel circuit P includes a light-emitting device. The display panel 810 includes n scan lines S1, S2 . . . , Sn−1, and Sn arranged in a row direction to transmit scan signals; m data lines D1, D2 . . . , and Dm arranged in a column direction to transmit data signals; n light-emitting control lines EM1, EM2 . . . , EMn−1, and EMn arranged in a row direction to transmit light-emitting control signals; and m first wires (not shown) and m second wires (not shown) for applying the first and second power voltages $V_{g1}$ and $V_{g2}$ A. n and m are natural numbers.

The first scan driver 802 is connected to the scan lines S1, S2 . . . , Sn−1, and Sn to apply scan signals to the display panel 810.

The second scan driver 804 is connected to the light-emitting control lines EM1, EM2 . . . , EMn−1, and EMn to apply light-emitting control signals to the display panel 810.

The data driver 806 is connected to the data lines D1, D2 . . . , and Dm to apply data signals to the display panel 810. Here, the data driver 106 supplies the data voltages to the pixel circuits P in the display panel 810 during data writing.

The power supply 808 applies the first power voltage $V_{g1}$ and the second power voltage $V_{g2}$ to each of the pixel circuits Pin the display panel 810.

The display apparatus 800 can be any product or component having a display function, such as a mobile phone, a tablet, a television, a monitor, a notebook computer, a digital photo frame, a navigator and the like.

It is apparent that various modifications and variations to the present disclosure can be made by those skilled in the art without departing from the spirit and scope of the disclosure. Thus, if these modifications and variations fall within the scope of the appended claims and equivalents thereof, the disclosure is also intended to encompass these modifications and variations.

What is claimed is:

1. A pixel circuit comprising:

a data write circuit connected to a scan line, a data line and a first node and configured to supply a data voltage on the data line to the first node in response to a scan signal on the scan line;

a reset circuit connected to the scan line, a reference voltage terminal and a second node and configured to supply a reference voltage from the reference voltage terminal to the second node in response to the scan signal on the scan line;

a first storage circuit connected between the second node and a third node and configured to be charged or discharged with a voltage across the second node and the third node;

a second storage circuit connected between a first power supply terminal and the third node and configured to be charged or discharged with a voltage across the first power supply terminal and the third node;

a light-emitting control circuit connected to a light-emitting control line, the first power supply terminal, the first node, the second node, and the third node and configured to, in response to a control signal on the light-emitting control line, provide a conduction path between the first power supply terminal and the third node and a conduction path between the first node and the second node; and a drive transistor having a gate connected to the first node, a source connected to the third node, and a drain connected to a light-emitting device and configured to drive the light-emitting device to emit light.

2. The pixel circuit of claim 1, wherein the data write circuit comprises a first switch transistor having a gate connected to the scan line, a first electrode connected to the data line, and a second electrode connected to the first node.

3. The pixel circuit of claim 1, wherein the reset circuit comprises a second switch transistor having a gate connected to the scan line, a first electrode connected to the reference voltage terminal, and a second electrode connected to the second node.

4. The pixel circuit of claim 1, wherein the light-emitting control circuit comprises:

a third switch transistor having a gate connected to the light-emitting control line, a first electrode connected to the first power supply terminal, and a second electrode connected to the third node; and a fourth switch transistor having a gate connected to the light-emitting control line, a first electrode connected to the second node, and a second electrode connected to the first node.

5. The pixel circuit of claim 1, wherein the first storage circuit comprises a first capacitor having a first terminal connected to the second node and a second terminal connected to the third node.

6. The pixel circuit of claim 1, wherein the second storage circuit comprises a second capacitor having a first terminal connected to the first power supply terminal and a second terminal connected to the third node.

7. The pixel circuit of claim 1, wherein the light-emitting device is an organic light-emitting diode.

8. The pixel circuit according to claim 1, wherein the drive transistor is a P-type transistor, and wherein the drain of the drive transistor is connected to an anode of the light-emitting device.

9. The pixel circuit according to claim 1, wherein the drive transistor is an N-type transistor, and wherein the drain of the drive transistor is connected to a cathode of the light-emitting device.

10. A display panel comprising:

a plurality of scan lines;

a plurality of light control lines;

a plurality of data lines intersecting the scan lines and the light-emitting control lines; and a plurality of pixel circuits arranged at intersections of the scan lines, the light-emitting control lines, and the data lines, each of the pixel circuits comprising:

a data write circuit connected to a corresponding one of the scan lines, a corresponding one of the data lines, and a first node, the data write circuit being configured to supply a data voltage on the corresponding data line to the first node in response to a scan signal on the corresponding scan line;

a reset circuit connected to the corresponding scan line, a reference voltage terminal, and a second node, the reset circuit being configured to supply a reference voltage from the reference voltage terminal to the second node in response to the scan signal on the corresponding scan line;

a first storage circuit connected between the second node and a third node, the first storage circuit being configured to be charged or discharged with a voltage across the second node and the third node;

a second storage circuit connected between a first power supply terminal and the third node, the second storage circuit being configured to be charged or discharged with a voltage across the first power supply terminal and the third node;

a light-emitting control circuit connected to a corresponding one of the light-emitting control lines, the first power supply terminal, the first node, the second node, and the third node, the light-emitting control circuit being configured to, in response to a control signal on the corresponding light-emitting control line, provide a conduction path between the first power supply terminal and the third node and a conduction path between the first node and the second node;

a light-emitting device having a first terminal and a second terminal connected to a second power supply terminal; and a drive transistor having a gate connected to the first node, a source connected to the third node, and a drain connected to the first terminal of the light-emitting device, the drive transistor being configured to drive the light-emitting device to emit light.

11. The display panel of claim 10, wherein the data write circuit comprises a first switch transistor having a gate connected to the corresponding scan line, a first gate connected to the corresponding data line, and a second electrode connected to the first node.

12. The display panel of claim 10, wherein the reset circuit comprises a second switch transistor having a gate connected to the corresponding scan line, a first electrode connected to the reference voltage terminal, and a second electrode connected to the second node.

13. The display panel of claim 10, wherein the light-emitting control circuit comprises:

a third switch transistor having a gate connected to the corresponding light-emitting control line, a first electrode connected to the first power supply terminal, and a second electrode connected to the third node; and a fourth switch transistor having a gate connected to the corresponding light-emitting control line, a first electrode connected to the second node, and a second electrode connected to the first node.

14. The display panel of claim 10, wherein the first storage circuit comprises a first capacitor having a first terminal connected to the second node and a second terminal connected to the third node.

15. The display panel of claim 10, wherein the second storage circuit comprises a second capacitor having a first terminal connected to the first power supply terminal and a second terminal connected to the third node.

16. The display panel of claim 10, wherein the light-emitting device is an organic light-emitting diode.

17. The display panel of claim 10, wherein the drive transistor is a P-type transistor, and wherein the first and second terminals of the light-emitting device are an anode and a cathode, respectively.

18. The display panel of claim 10, wherein the drive transistor is an N-type transistor, and wherein the first and second terminals of the light-emitting device are a cathode and an anode, respectively.

19. A display apparatus comprising the display panel of claim 10.

20. A method of driving the pixel circuit of claim 1, comprising:

during a first phase, providing, by the light-emitting control circuit, the conduction path between the first power supply terminal and the third node and the conduction path between the first node and the second node;

during a second phase, supplying, by the data write circuit, the data voltage on the data line to the first node and supplying, by the reset circuit, the reference voltage from the reference voltage terminal to the second node such that the first storage circuit and the second storage circuit are charged or discharged until a potential at the third node is equal to a value obtained by subtracting a threshold voltage of the drive transistor from the data voltage; and during a third phase, providing, by the light-emitting control circuit, the conduction path between the first power supply terminal and the third node and the conduction path between the first node and the second node such that the drive transistor drives the light-emitting device to emit light.

* * * * *